US010695617B1

(12) United States Patent
Madson

(10) Patent No.: US 10,695,617 B1
(45) Date of Patent: Jun. 30, 2020

(54) MINIMAL SURFACE GOLF BALL COMPONENTS

(71) Applicant: Acushnet Company, Fairhaven, MA (US)

(72) Inventor: Michael R. Madson, Easton, MA (US)

(73) Assignee: Achushnet Company, Fairhaven, MA (US)

( * ) Notice: Subject to any disclaimer, the term of this patent is extended or adjusted under 35 U.S.C. 154(b) by 0 days.

(21) Appl. No.: 16/226,755

(22) Filed: Dec. 20, 2018

(51) Int. Cl.
*A63B 37/00* (2006.01)
*A63B 37/06* (2006.01)
*A63B 37/08* (2006.01)

(52) U.S. Cl.
CPC ..... *A63B 37/006* (2013.01); *A63B 37/0038* (2013.01); *A63B 37/0039* (2013.01); *A63B 37/06* (2013.01); *A63B 37/08* (2013.01); *A63B 2037/065* (2013.01)

(58) Field of Classification Search
CPC . A63B 37/00; A63B 37/0003; A63B 37/0038; A63B 37/0039; A63B 37/0097; A63B 37/006
See application file for complete search history.

(56) References Cited

U.S. PATENT DOCUMENTS

| | | | | |
|---|---|---|---|---|
| 1,524,171 | A * | 1/1925 | Chatfield | A63B 37/0003 473/373 |
| 4,229,401 | A | 10/1980 | Pocklington | |
| 6,398,667 | B1 | 6/2002 | Lemons | |
| 9,782,632 | B1 * | 10/2017 | Breaker | A63B 37/0039 |
| 2005/0054463 | A1 * | 3/2005 | Ninomiya | A63B 37/0003 473/371 |
| 2010/0056300 | A1 * | 3/2010 | Cooper | A63B 37/0038 473/374 |
| 2010/0075776 | A1 * | 3/2010 | Nardacci | A63B 37/0039 473/371 |
| 2014/0014493 | A1 | 1/2014 | Ryan | |
| 2015/0375062 | A1 * | 12/2015 | Farrell | A63B 37/0093 473/376 |
| 2017/0050087 | A1 * | 2/2017 | Sullivan | A63B 37/0058 |
| 2017/0291077 | A1 * | 10/2017 | Madson | B29C 64/135 |

* cited by examiner

*Primary Examiner* — John E Simms, Jr.
(74) *Attorney, Agent, or Firm* — Mandi B. Milbank

(57) ABSTRACT

The present invention provides a novel golf ball construction including a layer having a design based on a minimal surface. The layer is defined by an envelope shape having an outer boundary and an inner boundary, and consists of a minimal surface and an interstitial space, the minimal surface and interstitial space being bounded by the envelope shape. The minimal surface is a single continuous surface which does not intersect itself and has zero mean curvature.

27 Claims, 12 Drawing Sheets

MINIMAL SURFACE GOLF BALL COMPONENTS

FIELD OF THE INVENTION

The present invention relates to golf ball components, particularly golf ball intermediate and cover layers, based on a minimal surface design.

BACKGROUND OF THE INVENTION

Minimal surfaces are surfaces with zero mean curvature, also characterized as surfaces of minimal surface area for given boundary conditions. Uses for minimal surfaces have been studied in areas such as high rise construction, scaffolding design for tissue engineering, and mass transfer processes. For example, U.S. Patent Application Publication No. 2014/0014493 discloses mass transfer packing with a minimal surface which purportedly enables significantly improved performance for separation and mixing. Minimal surface structures have not previously been explored for use in golf balls.

SUMMARY OF THE INVENTION

The present invention is directed to a golf ball comprising a core, an intermediate layer, and a dimpled outer cover layer. The intermediate layer is defined by an envelope shape having an outer boundary and an inner boundary and consists of a triply periodic minimal surface and an interstitial space, the minimal surface and the interstitial space being bounded by the envelope shape of the intermediate layer. The minimal surface is a single continuous surface which does not intersect itself and has zero mean curvature.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION

Figure 1A:
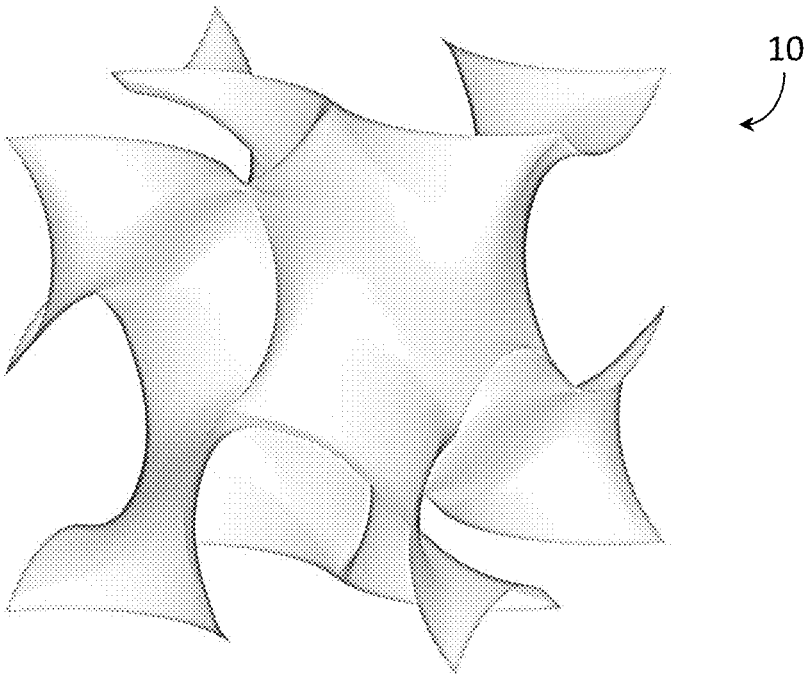
FIGS. 1A and 1B illustrate a perspective view of a minimal surface bounded by an envelope shape according to an embodiment of the present invention.

Golf balls of the present invention have a novel construction wherein an intermediate layer consists of a minimal surface and an interstitial shape, which are confined within an envelope shape. A minimal surface is a surface that locally minimizes its area. The minimization of area within the confines of a given boundary allows for especially low density to envelope volume ratios, which allows for new methods of distributing weight and materials within a golf ball without sacrificing speed or durability. Another advantage provided by minimal surfaces results from the absence of discontinuities, or sharp corners, in the single continuous surface of minimal surfaces, potentially allowing for improved durability relative to conventional golf balls. Another potential advantage of using minimal surfaces in golf ball layers is high resilience regardless of orientation due to the multiple symmetrical axes that exist in minimal surfaces. The use of minimal surfaces in golf ball layers also has the potential to allow for making super thin urethane covers without difficulties in maintaining concentricity.

For purposes of the present disclosure, a "minimal surface" is a surface that is confined to an envelope shape and has the following properties.

a) the surface is a single, continuous surface;

b) the surface does not intersect itself;

c) the surface is free of any discontinuities, except where the surface terminates at the outer boundary and inner boundary of the envelope shape; and d) the surface has zero mean curvature.

For purposes of the present disclosure, a "discontinuity" in the minimal surface refers to a sharp corner that may create a stress raiser. Thus, minimal surfaces of the present invention are free of sharp edges that are not located at one of the boundaries of the envelope shape.

For purposes of the present disclosure, "zero mean curvature" means that the mean curvature of the minimal surface is zero at every point on the surface. Mean curvature is the average of the two principle curvatures. Principle curvatures are the maximum and minimum of the normal curvature at a given point on a surface. In other words, for each point on the surface, there is a point on the opposing side with equal and opposite curvature, such that the mean curvature for the entire surface is zero.

Minimal surfaces suitable for use in golf ball intermediate layers are triply periodic, meaning, for purposes of the present invention, that the surface has a base unit that repeats periodically along three different axes. For purposes of the present disclosure, "base unit" refers to a base minimal surface structure that is patterned along three axes to generate a triply periodic minimal surface.

The pure mathematical definition of a "surface" does not exist in three-dimensional space. Thus, for purposes of the present invention, the mathematical surfaces described herein are prescribed a particular thickness, t, in order to create a manufacturable component. In a particular embodiment, minimal surfaces of the present invention have a thickness, t, of from 0.001 inches to 0.030 inches. In another particular embodiment, the thickness of the minimal surface is constant, i.e., the thickness of the minimal surface is about equal at all points. For purposes of the present disclosure, the thickness of the minimal surface is constant if the thickness at any point on the minimal surface is no more than 0.002 inches different from the average thickness of the minimal surface. In another particular embodiment, the thickness of the minimal surface is non-constant.

For purposes of the present disclosure, the term "envelope shape" is used herein to refer to the three-dimensional shape within which a minimal surface is restricted.

Figure 1B:
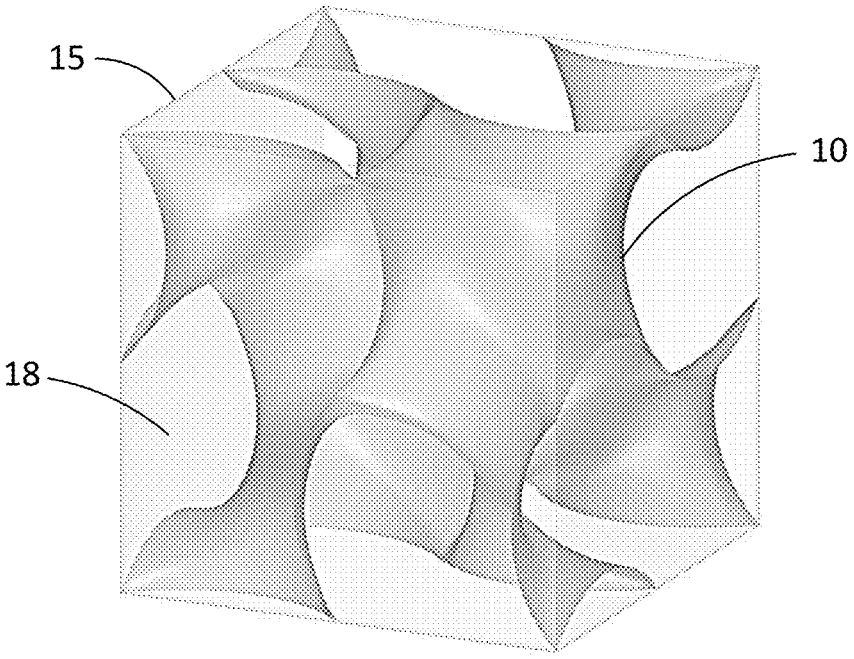

For example, FIG. 1A shows a minimal surface 10 confined to a cubic envelope shape, according to an embodiment of the present invention. FIG. 1B shows the minimal surface 10 of FIG. 1A and the cube 15 to which the minimal surface 10 is confined. Also shown in FIG. 1B is an interstitial space 18 bounded by the cube 15 to which the minimal surface 10 is confined. The minimal surface shown in FIGS. 1A and 1B is a single base unit.

Figure 2A:
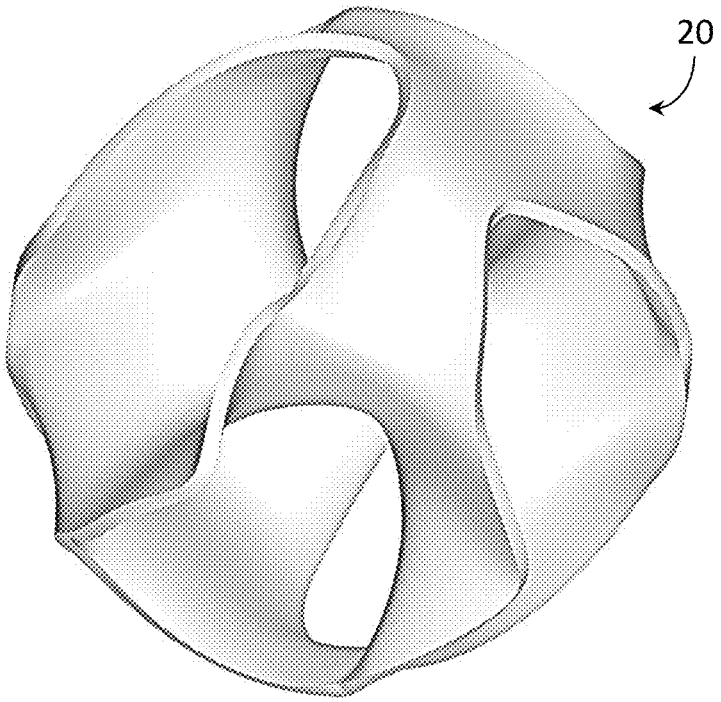
FIGS. 2A and 2B illustrate a perspective view of a minimal surface bounded by an envelope shape according to another embodiment of the present invention.
Figure 2B:
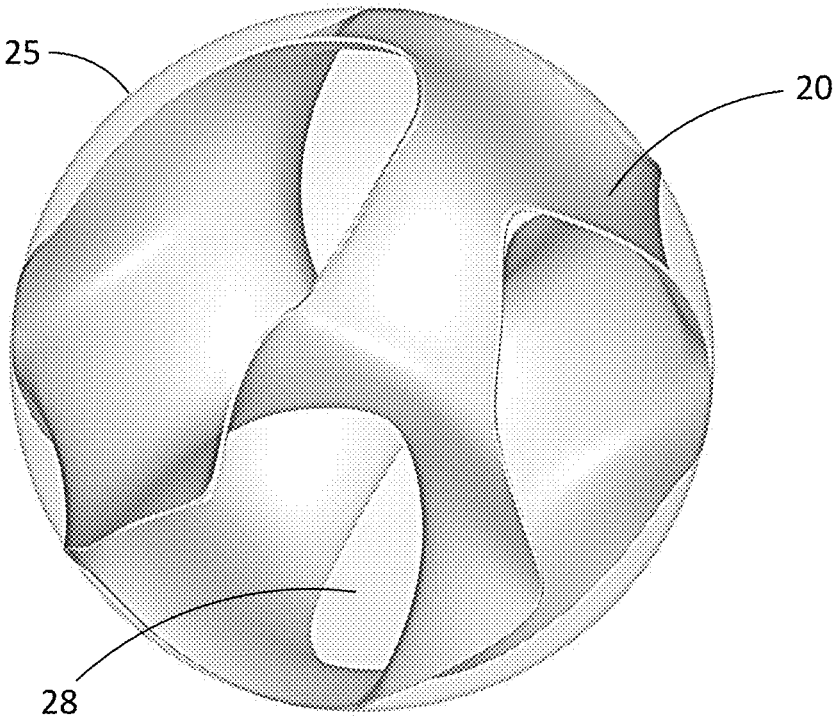

FIG. 2A shows a minimal surface 20 confined to a spherical envelope shape, according to an embodiment of the present invention. FIG. 2B shows the minimal surface 20 of FIG. 2A and the sphere 25 to which the minimal surface 20 is confined. Also shown in FIG. 2B is an interstitial space 28 bounded by the sphere 25 to which the minimal surface 20 is confined. The minimal surface shown in FIGS. 2A and 2B is the single base unit of FIGS. 1A and 1B confined to a spherical envelope shape.

Figure 3A:
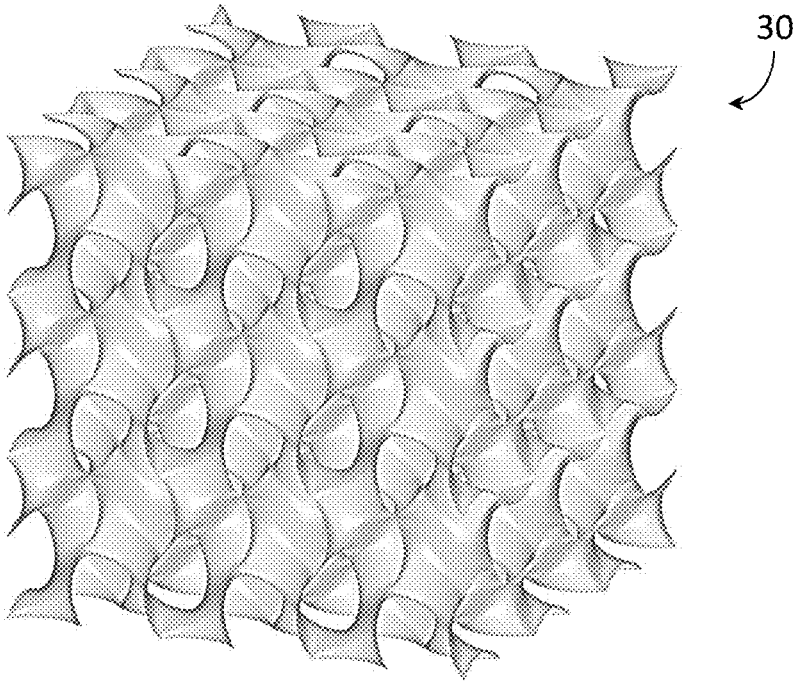
FIGS. 3A and 3B illustrate perspective views of a minimal surface bounded by an envelope shape according to another embodiment of the present invention.
Figure 3B:
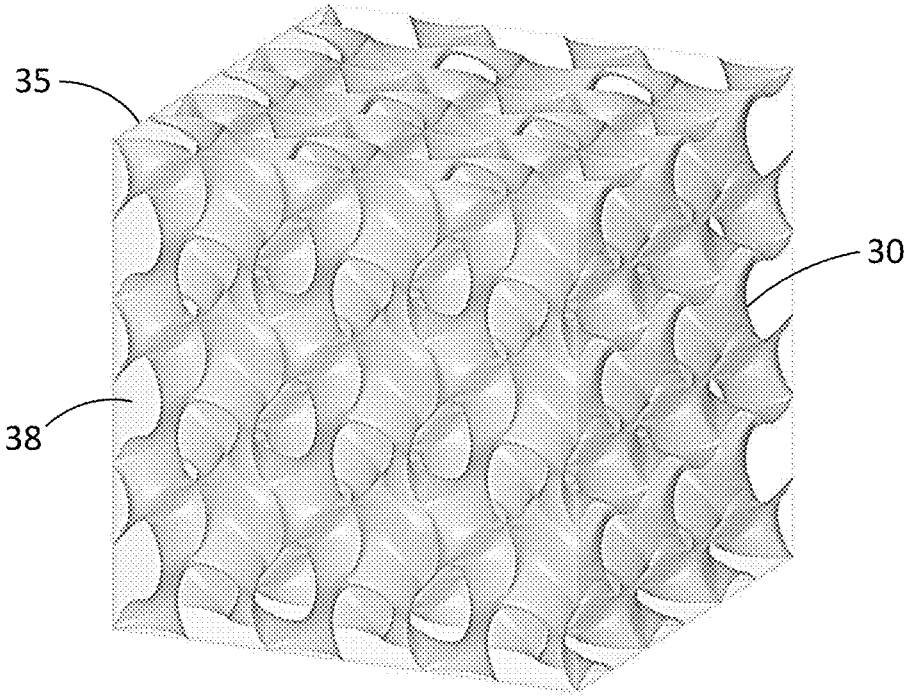

FIG. 3A shows a triply periodic minimal surface 30 confined to a cubic envelope shape, according to an embodiment of the present invention. FIG. 3B shows the triply periodic minimal surface 30 of FIG. 3A and the cube 35 to which the triply periodic minimal surface 30 is confined. Also shown in FIG. 3B is an interstitial space 38 bounded by the cube 35 to which the minimal surface 30 is confined.

Figure 3C:
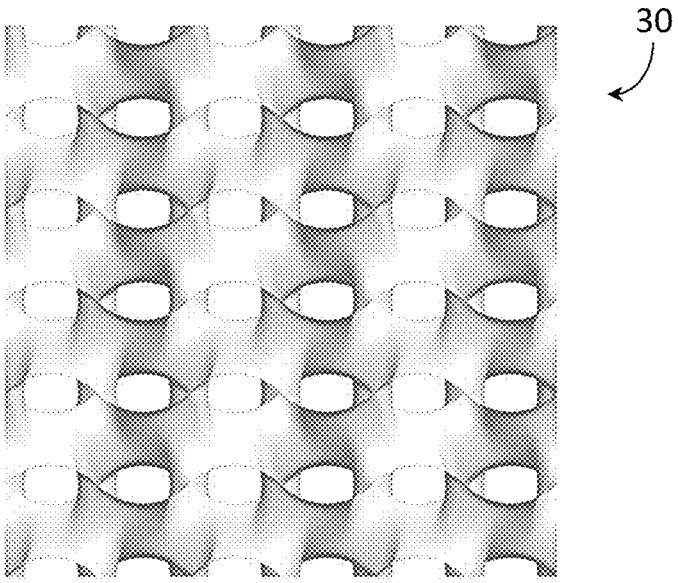
FIGS. 3C-3F are planar views of the minimal surface illustrated in FIGS. 3A and 3B.
Figure 3D:
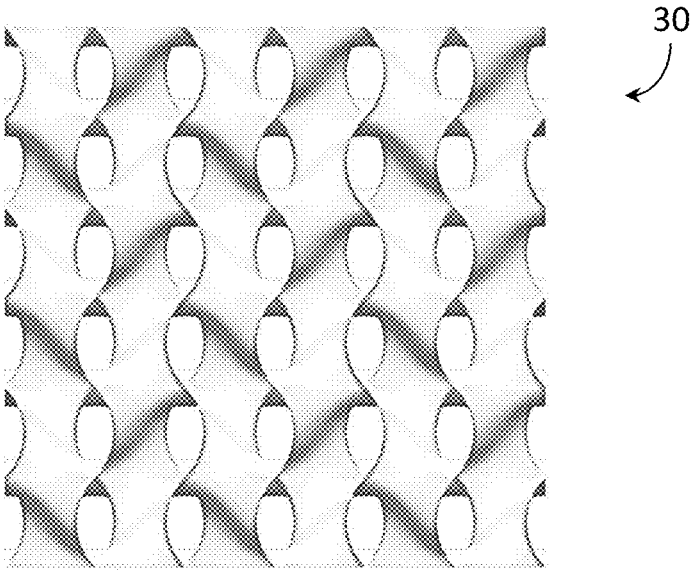
Figure 3E:
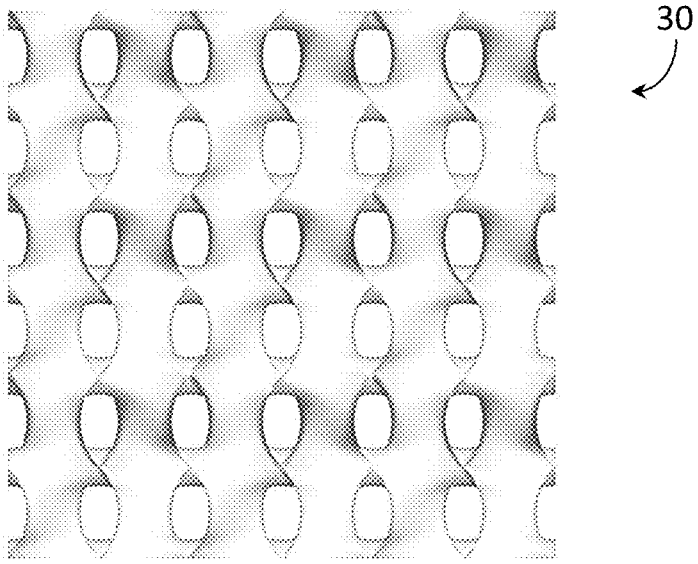
Figure 3F:
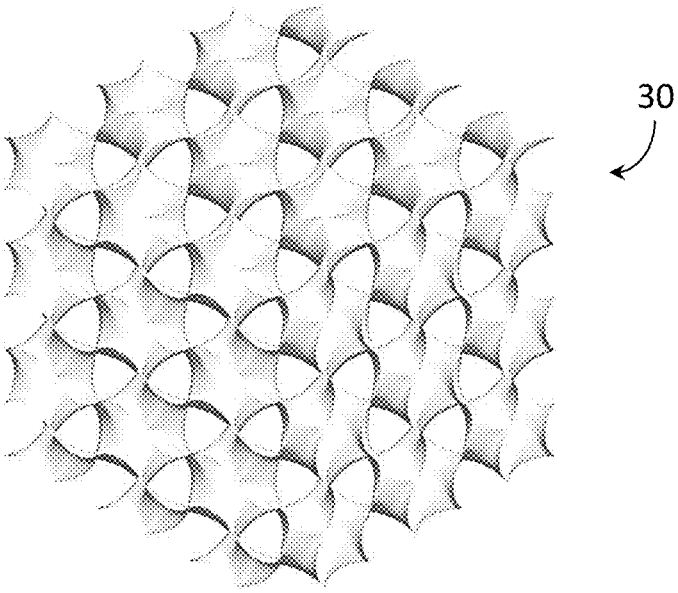

FIGS. 3C-3E are a front view, a right side view, and a top view, respectively, of the triply periodic minimal surface 30 of FIGS. 3A and 3B. FIG. 3F is a planar view of the triply periodic minimal surface 30 illustrated in FIGS. 3A-3E, wherein the viewing plane is normal to an axis connecting the centroid of the cubic envelope shape to a vertex of the cubic envelope shape.

In the embodiment shown in FIGS. 3A-3F, the triply periodic minimal surface 30 is created using the minimal surface 10 of FIGS. 1A and 1B as a base unit and repeating the base unit along three different axes, the triply periodic minimal surface terminating at a cubic envelope shape.

Figure 4A:
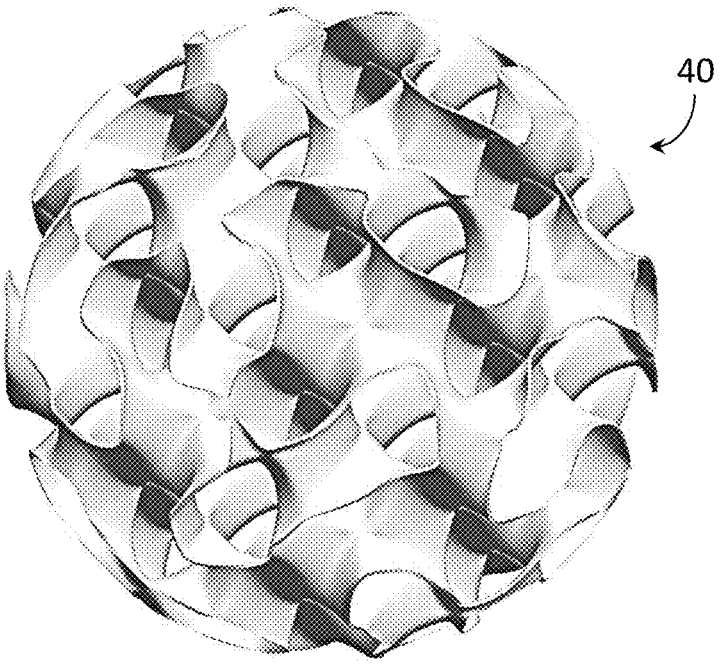
FIGS. 4A and 4B illustrate perspective views of a triply periodic minimal surface bounded by an envelope shape according to an embodiment of the present invention.
Figure 4B:
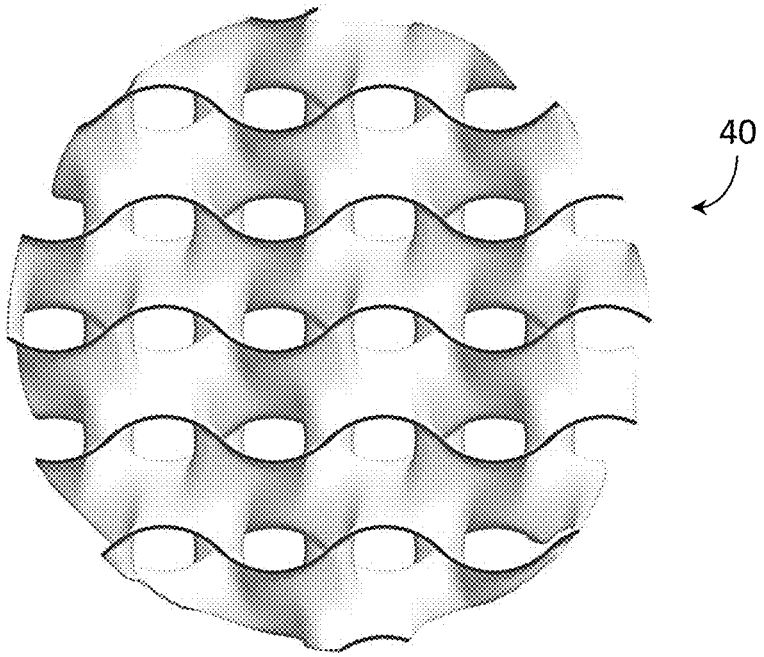

FIGS. 4A and 4B are perspective views of a triply periodic minimal surface 40 confined to a spherical envelope shape, according to an embodiment of the present invention. In the embodiment shown in FIGS. 4A-4B, the triply periodic minimal surface 40 is created using the minimal surface 10 of FIGS. 1A and 1B as a base unit and repeating the base unit along three different axes, the triply periodic minimal surface terminating at a spherical envelope shape.

Many minimal surfaces are known, and the present invention is not meant to be limited to a particular minimal surface. Triply periodic minimal surfaces are particularly suitable, including, but not limited to, triply periodic surfaces having a base unit selected from Schoen's Gyroid (G) Surface, Schwarz's P Surface, Schwarz's D Surface, Schoen's Complementary D Surface, Schoen's F-RD Surface, Schoen's GW Surface, Schoen's I-WP Surface, Neovius's Surface, Schoen's Batwing Surface, Brakke's Pseudo-Batwing Surface, Lord and MacKay P3a Surface, Fisher-Koch S Surface, and hybrids thereof, such as Schoen's O,C-TO Surface hybrid of the P Surface and the I-WP Surface. The minimal surfaces shown in the figures are based on an approximation of Schoen's Gyroid (G) Surface, created using SolidWorks.

In the present invention, the minimal surface is used to form an intermediate layer of a golf ball. Thus, for purposes of the present disclosure, the envelope shape within which the minimal surface is restricted has an outer boundary and an inner boundary, the outer and inner boundaries of the envelope shape defining the outer and inner boundaries of the intermediate layer. The remaining volume of the envelope shape that encompasses the minimal surface is the interstitial space of the intermediate layer. It should be understood that the outer and inner boundaries of the envelope shape are reference boundaries relating to the space within which the minimal surface and interstitial space of the intermediate layer are restricted, and are not necessarily solid surfaces in the final golf ball. For example, the intermediate layer does not have a solid outer or inner surface when the interstitial space is hollow or liquid-filled.

The outer and inner boundaries of the envelope shapes are defined by the outer surface of three-dimensional shapes. Non-limiting examples of suitable three-dimensional shapes for use in defining the outer and inner boundaries are spheres and regular shapes, such as cubes, octahedrons, cuboctahedrons, dodecahedrons, tetrahedrons, and icosahedrons, which have equal sides and equal interior angles. The outer and inner boundary of envelope shapes of the present invention can be defined by the same three-dimensional shape or a combination of any two of the three-dimensional shapes given above. For example, in a particular embodiment, the envelope shape has an outer boundary defined by the outer surface of a sphere and an inner boundary defined by the outer surface of a sphere. In another particular embodiment, the envelope shape has an outer boundary defined by the outer surface of a cube and an inner boundary defined by the outer surface of a cube. In another particular embodiment, the envelope shape has an outer boundary defined by the outer surface of a sphere and an inner boundary defined by the outer surface of a cube.

Figure 5A:
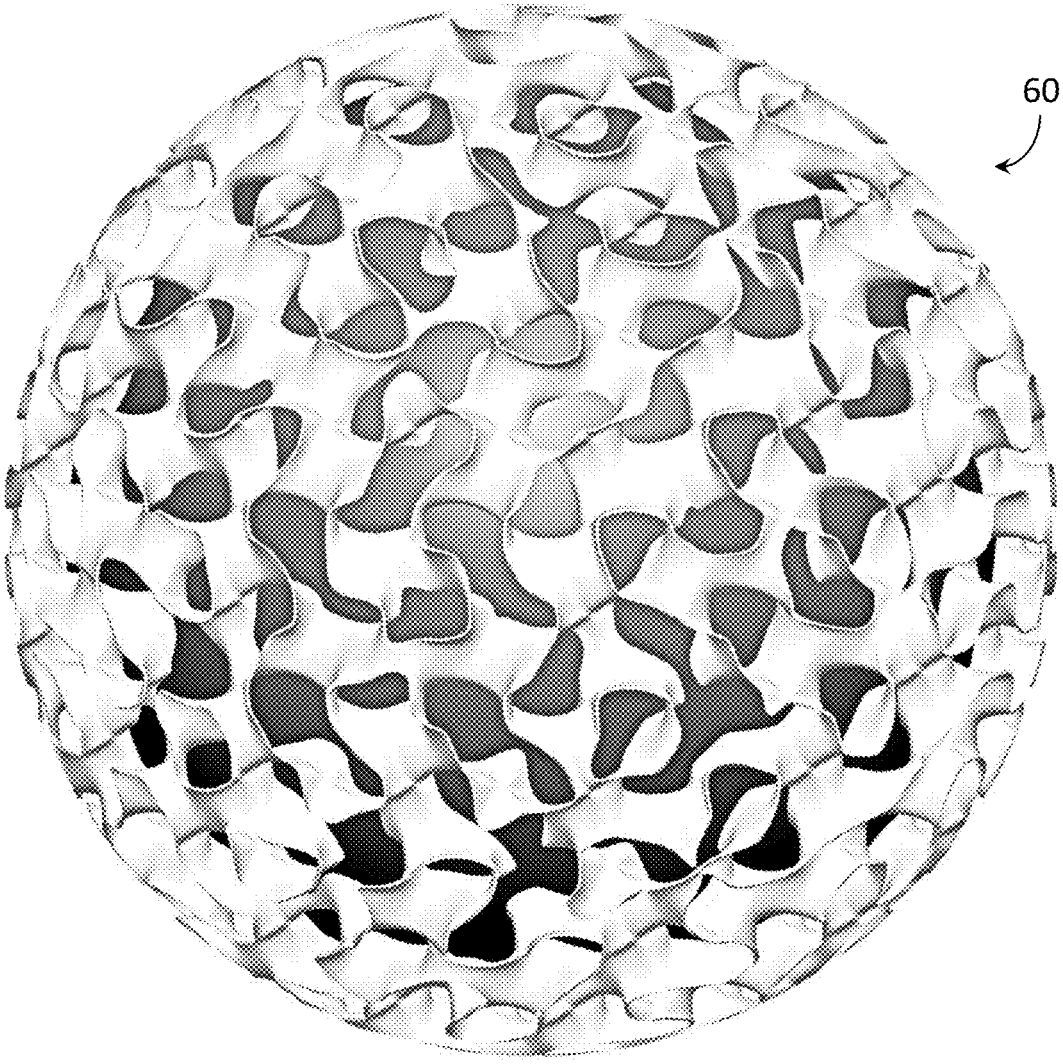
FIG. 5A is a perspective view of a golf ball subassembly according to an embodiment of the present invention.
Figure 5B:
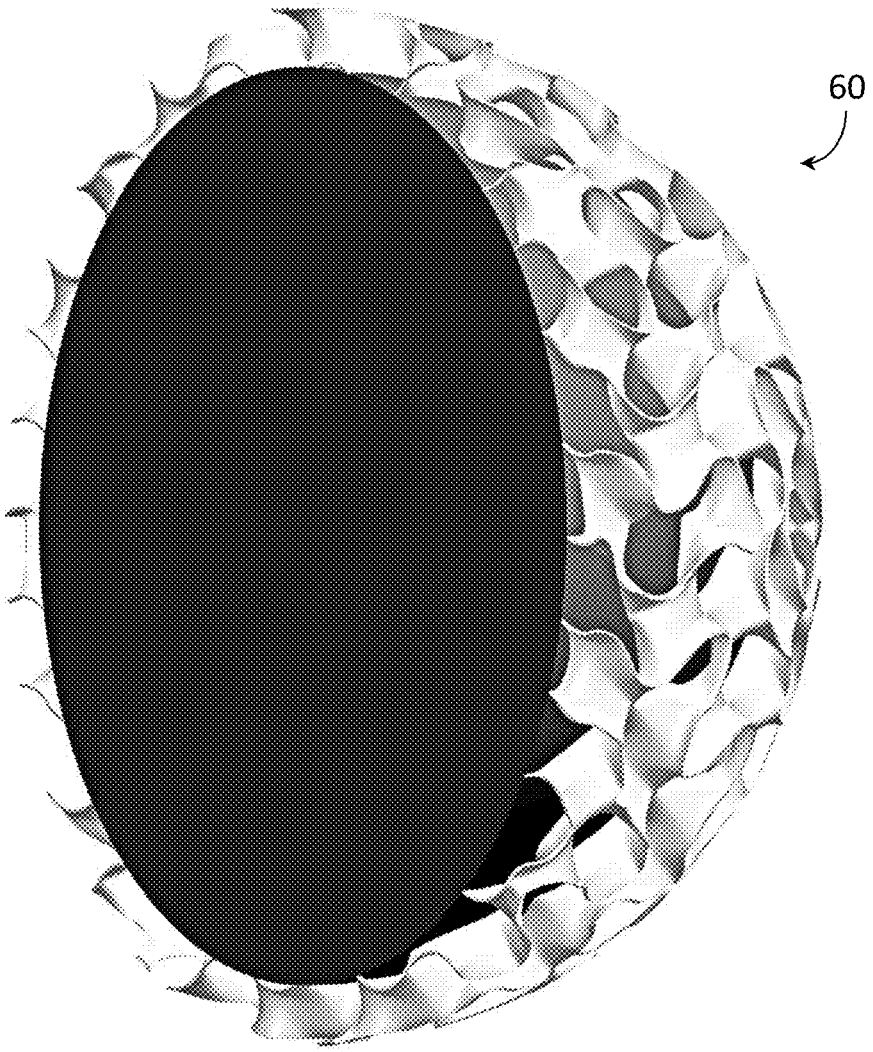
FIG. 5B is an isometric section view of the golf ball subassembly of FIG. 5A.
Figure 5C:
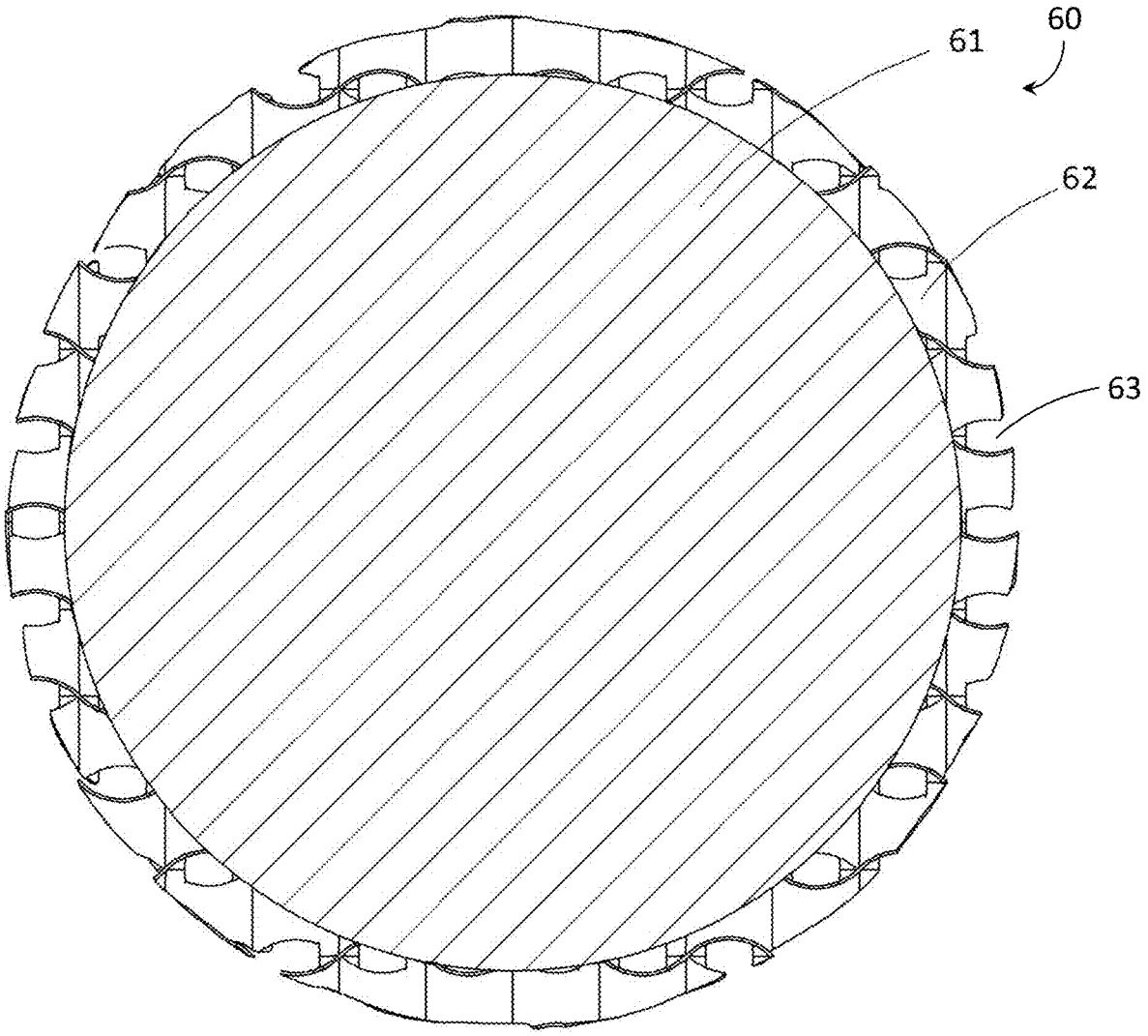
FIG. 5C is a section view of the golf ball subassembly of FIGS. 5A and 5B.

For example, FIGS. 5A-5C show a golf ball subassembly 60 consisting of an intermediate layer disposed about a core. As indicated in FIG. 5C, the intermediate layer consists of a minimal surface 62 and an interstitial space 63, disposed about a core 61. In FIGS. 5A-5C, the minimal surface is a triply periodic minimal surface created using the minimal surface 10 of FIGS. 1A and 1B as a base unit and repeating the base unit along three different axes, terminating at an outer boundary and an inner boundary of an envelope shape. As shown in FIGS. 5A-5C, the envelope shape within which the minimal surface is restricted has an outer boundary defined by the outer surface of a first sphere and an inner boundary defined by the outer surface of a second sphere, the first sphere having a larger diameter than the second sphere. In a particular aspect of the embodiment of the golf ball subassembly shown in FIGS. 5A-5C, the first sphere, which defines the outer boundary of the envelope shape, has a diameter of from 0.5 inches to 1.67 inches, and the second sphere, which defines the inner boundary of the envelope shape, has a diameter of from 0.25 inches to 1.63 inches. In a further particular aspect of the embodiment of the golf ball subassembly shown in FIGS. 5A-5C, the envelope shape has:

- a spherical outer boundary having a diameter of about 1.620 inches,
- a spherical inner boundary having a diameter of about 1.435 inches,
- an average surface area ($A_E$) of about 7.357 $in^2$, and
- an envelope volume ($V_E$) of about 0.679 $in^3$;

and the minimal surface has:

- a constant thickness of about 0.005 inches,
- a surface area ($A_M$) of about 15.470 $in^2$, and
- a volume ($V_M$) of about 0.0435 $in^3$.

The volume of the envelope shape is the envelope volume, $V_E$, and is calculated as the volume of the three-dimensional shape defining the outer boundary of the envelope shape, $V_{OUTER}$, minus the volume of the three-dimensional shape defining the inner boundary of the envelope shape, $V_{INNER}$.

The average surface area of the envelope shape, $A_E$, is calculated as the average of the surface area of the three-dimensional shape defining the outer boundary of the envelope shape ($A_{OUTER}$) and the surface area of the three-dimensional shape defining the inner boundary of the envelope shape ($A_{INNER}$).

For purposes of the present disclosure, the "envelope volume ratio" is the ratio of the volume of the minimal surface, $V_M$, to the volume of the envelope shape, $V_E$, and is less than 1, or less than 0.50 or less than 0.25. Thus, in a further particular aspect of the embodiment of the golf ball subassembly shown in FIGS. 5A-5C, the envelope volume ratio is about 0.064.

For purposes of the present disclosure, the "envelope surface area ratio" is the ratio of the surface area of the minimal surface, $A_M$, to the average surface area of the envelope shape, $A_E$, and is either less than 1 or greater than 1 or greater than 2 or greater than 4. Thus, in a further particular aspect of the embodiment of the golf ball subassembly shown in FIGS. 5A-5C, the envelope surface area ratio is about 2.10.

The interstitial space of the intermediate layer can be hollow or filled. In embodiments of the present invention wherein the interstitial space of the intermediate layer is filled, the material used to fill the interstitial space can terminate at the outer boundary of the envelope shape of the intermediate layer or extend beyond the outer boundary of the envelope shape and form a layer that surrounds the intermediate layer. Likewise, in embodiments of the present invention wherein the interstitial space of the intermediate layer is filled, the material used to fill the space can terminate at the inner boundary of the envelope shape of the intermediate layer or extend beyond the inner boundary of the envelope shape. In embodiments of the present invention wherein the material used to fill the interstitial space extends beyond the inner boundary of the envelope shape of the intermediate layer, the material of the interstitial space can fill the interior portion of the golf ball and form a liquid-filled or foamed or unfoamed solid core, or the material can terminate at a surface (i.e., the outer surface of the core or outer surface of a layer disposed about the core) and form a layer that is surrounded by the intermediate layer.

In embodiments of the present invention wherein the material used to fill the interstitial space extends beyond the outer boundary of the envelope shape of the intermediate layer, the material terminates at a surface that can have the same shape or a different shape than the outer boundary of the envelope shape. For example, in a particular embodiment, the outer boundary of the envelope shape is defined by the outer surface of a sphere, and the material used to fill the interstitial space extends beyond the outer boundary of the envelope shape and terminates at a surface defined by the outer surface of a sphere. In another particular embodiment, the outer boundary of the envelope shape is defined by the outer surface of a cube, and the material used to fill the interstitial space extends beyond the outer boundary of the envelope shape and terminates at a surface defined by the outer surface of a sphere.

In embodiments of the present invention wherein the material used to fill the interstitial space extends beyond the inner boundary of the envelope shape of the intermediate layer and terminates at a surface, the surface can have the same shape or a different shape than the inner boundary of the envelope shape. For example, in a particular embodiment, the inner boundary of the envelope shape is defined by the outer surface of a sphere, and the material used to fill the interstitial space extends beyond the inner boundary of the envelope shape and terminates at a surface defined by the outer surface of a sphere. In another particular embodiment, the inner boundary of the envelope shape is defined by the outer surface of a cube, and the material used to fill the interstitial space extends beyond the inner boundary of the envelope shape and terminates at a surface defined by the outer surface of a sphere.

Minimal surfaces for use in golf ball intermediate layers can be manufactured using rapid prototyping methods, including, but not limited to, continuous liquid interface printing methods, such as those disclosed, for example, in U.S. Pat. No. 10,016,661, the entire disclosure of which is hereby incorporated herein by reference, and conventional 3D printing methods. Materials suitable for forming the minimal surface include those that are capable of being used in such rapid prototyping methods, including light-curable polymerizable materials, such as sol-gel, polyesters, vinyl ethers, acrylates, methacrylates, polyurethanes, polyureas, bio-absorbable resins, silicones, epoxides, cyanate esters, hydrogels, investment casting resins, polycarbonates, and thiol-enes. Also suitable for forming the minimal surface are conventional golf ball materials, including those disclosed herein as suitable for forming core layers and cover layers.

In a particular embodiment, the minimal surface is formed from a ultraviolet (UV) light polymerizable resin comprising a photoinitiator and a mixture of light-curable oligomers and monomers. Preferably, the UV light polymerizable resin comprises a light-curable oligomer in an amount of 60 wt % or greater, based on the total weight of the resin. Particularly suitable oligomers include, but are not limited to, epoxides, urethanes, polyethers, polyesters, acrylics, and mixtures of two or more thereof, preferably functionalized by an acrylate. In a particular embodiment, the oligomer is selected from acrylated polyethers, acrylated polyesters, acrylated acrylics, polybutadiene dimethacrylate, and polybutadiene diacrylate. Non-limiting examples of commercially available acrylated oligomers that are suitable for use in the present invention include Laromer® PE 44F and Laromer® PE 8981 polyester acrylates, commercially available from BASF; Ebecryl™ chlorinated acrylated polyesters, commercially available from Allnex; and CN 301 polybutadiene dimethacrylate and CN 302 polybutadiene diacrylate, commercially available from Sartomer.

Preferably, the UV light polymerizable resin comprises a light-curable monomer in an amount of 20 wt % or greater, based on the total weight of the resin. Particularly suitable monomers for use in the UV light polymerizable resin include, but are not limited to, styrene monomers, N-vinylpyrrolidone monomers, and acrylic monomers. These monomers can help control the properties of the resin, such as cure speed, cross-link density, and viscosity. In a particular embodiment, the monomer is selected from acrylic monomers, such as pentaerythritol triacrylate (PETA), trimethylolpropane triacrylate (TMPTA), 1,6 hexanediol diacrylate (HODA), tripropylene glycol diacrylate (TRPGDA), triethylene glycol diacrylate (TREGDA), 2-ethylhexyl acrylate, vinyl acetate, butyl acrylate, dimethylaminoethyl acrylate, isobutoxymethyl acrylamide, and dimethylacrylamide. Non-limiting examples of commercially available acrylic monomers that are suitable for use in the present invention include TMPTA trimethylolpropane triacrylate and Ebecryl™ 40 tetraacrylate monomer, commerically available from Allnex.

Preferably, the UV light polymerizable resin comprises a photoinitiator in an amount of 3 wt % or greater, based on the total weight of the resin, and is cured using UV light radiation. However, the resin may also be cured using other light and energy curing sources, including, but not limited to, visible light and electron beam. Suitable photoinitiators include anionic and cationic photoinitiators, such as styrenic compounds, vinyl ethers, N-vinyl carbazoles, lactones, lactams, cyclic ethers, cyclic acetals, cyclic siloxanes, benzoin ethers, and benzophenone. In a particular embodiment, the photoinitiator is selected from 1-hydroxy-cyclohexyl-phenyl-ketone and a blend of trimethylbenzophenone, polymeric hydroxy ketone, and trimethylbenzoyldiphenyl phosphine oxide. Non-limiting examples of commercially available photoinitiators that are suitable for use in the present invention include Irgacure® 184 1-hydroxy-cyclohexyl-phenyl-ketone photoinitiator and Irgacure® 819 phenyl bis (2,4,6-trimethyl benzoyl) phosphine oxide photoinitiator, commercially available from Ciba Specialty Chemicals; and Esacure KTO-46 blend of trimethylbenzophenone, polymeric hydroxy ketone, and trimethylbenzoyldiphenyl phosphine oxide, commercially available from IGM resins.

Various other thermoplastic and thermoset materials, fillers, and other additives, such as inhibitors, surfactants, waxes, cure accelerators, defoaming agents, pigments, dispersing agents, optical brighteners, UV light stabilizers, UV absorbers, adhesion promoters, and the like, may be added to the resin. Inhibitors may be used to retard or stop undesirable polymerization of the oligomers and monomers.

The interstitial space of the intermediate layer may be filled with any suitable liquid, foamed, or unfoamed solid composition. Particularly suitable compositions for filling the interstitial space of the intermediate layer include, but are not limited to, foamed highly neutralized polymers, such as those disclosed in U.S. Pat. No. 7,708,654 to Sullivan et al., the entire disclosure of which is hereby incorporated herein by reference; foamed polyurethanes, such as those disclosed in U.S. Pat. No. 9,254,422 to Sullivan et al., the entire disclosure of which is hereby incorporated herein by reference; castable polyurethanes, such as those disclosed in U.S. Pat. No. 9,254,422 to Sullivan et al.; the entire disclosure of which is hereby incorporated herein by reference; and rubbers.

Golf balls of the present invention include a hollow core, liquid-filled core, or solid core having one or more layers. Particularly suitable materials for forming core layers include, but are not limited to, thermosetting materials, such as styrene butadiene, polybutadiene, isoprene, polyisoprene, and trans-isoprene; thermoplastics, such as ionomer resins, polyamides and polyesters; and thermoplastic and thermosetting polyurethane and polyureas. Particularly preferred core compositions are thermosetting rubber compositions comprising a base polymer, an initiator agent, a coagent and/or a curing agent, and optionally one or more of a metal oxide, metal fatty acid or fatty acid, antioxidant, soft and fast agent, fillers, and additives. Suitable base polymers include natural and synthetic rubbers including, but not limited to, polybutadiene, polyisoprene, ethylene propylene rubber ("EPR"), styrene-butadiene rubber, styrenic block copolymer rubbers (such as SI, SIS, SB, SBS, SIBS, and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, acrylonitrile butadiene rubber, polychloroprene, alkyl acrylate rubber, chlorinated isoprene rubber, acrylonitrile chlorinated isoprene rubber, polyalkenamers, and combinations of two or more thereof. Suitable initiator agents include organic peroxides, high energy radiation sources capable of generating free radicals, C—C initiators, and combinations thereof. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Suitable curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof. Suitable types and amounts of base polymer, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication No. 2007/0093318, the entire disclosure of which is hereby incorporated herein by reference.

Golf balls of the present invention include a single-, dual-, or multi-layer cover. Particularly suitable materials for forming cover layers include, but are not limited to:

a) polyurethanes, polyureas, and hybrids of polyurethane and polyurea;
b) E/X- and E/X/Y-type ionomers, wherein E is an olefin (e.g., ethylene), X is a carboxylic acid (e.g., acrylic, methacrylic, crotonic, maleic, fumaric, or itaconic acid), and Y is a softening comonomer (e.g., vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons), such as Surlyn® ionomer resins and DuPont® HPF 1000 and HPF 2000, commercially available from E. I. du Pont de Nemours and Company, Iotek® ionomers, commercially available from ExxonMobil Chemical Company, Amplify® IO ionomers of ethylene acrylic acid copolymers, commercially available from The Dow Chemical Company, and Clarix® ionomer resins, commercially available from A. Schulman Inc.;
c) polyisoprene;
d) polyoctenamer, such as Vestenamer® polyoctenamer, commercially available from Evonik Industries;
e) polyethylene, including, for example, low density polyethylene, linear low density polyethylene, and high density polyethylene; polypropylene;
f) rubber-toughened olefin polymers; non-ionomeric acid copolymers, e.g., (meth)acrylic acid, which do not become part of an ionomeric copolymer;
g) plastomers;
h) flexomers;
i) styrene/butadiene/styrene block copolymers;

j) styrene/ethylene-butylene/styrene block copolymers;
k) polybutadiene;
l) styrene butadiene rubber;
m) ethylene propylene rubber;
n) ethylene propylene diene rubber;
o) dynamically vulcanized elastomers;
p) ethylene vinyl acetates;
q) ethylene (meth) acrylates;
r) polyvinyl chloride resins;
s) polyamides, amide-ester elastomers, and copolymers of ionomer and polyamide, including, for example, Pebax® thermoplastic polyether and polyester amides, commercially available from Arkema Inc;
t) crosslinked trans-polyisoprene;
u) polyester-based thermoplastic elastomers, such as Hytrel® polyester elastomers, commercially available from E. I. du Pont de Nemours and Company, and Riteflex® polyester elastomers, commercially available from Ticona;
v) polyurethane-based thermoplastic elastomers, such as Elastollan® polyurethanes, commercially available from BASF;
w) synthetic or natural vulcanized rubber;
x) and combinations thereof.

Compositions comprising an ionomer or a blend of two or more E/X- and E/X/Y-type ionomers are particularly suitable cover materials. Preferred E/X- and E/X/Y-type ionomeric cover compositions include:

(a) a composition comprising a "high acid ionomer" (i.e., having an acid content of greater than 16 wt %), such as Surlyn 8150®;
(b) a composition comprising a high acid ionomer and a maleic anhydride-grafted non-ionomeric polymer (e.g., Fusabond® functionalized polymers). A particularly preferred blend of high acid ionomer and maleic anhydride-grafted polymer is a 84 wt %/16 wt % blend of Surlyn 8150® and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;
(c) a composition comprising a 50/45/5 blend of Surlyn® 8940/Surlyn® 9650/Nucrel® 960, preferably having a material hardness of from 80 to 85 Shore C;
(d) a composition comprising a 50/25/25 blend of Surlyn® 8940/Surlyn® 9650/Surlyn® 9910, preferably having a material hardness of about 90 Shore C;
(e) a composition comprising a 50/50 blend of Surlyn® 8940/Surlyn® 9650, preferably having a material hardness of about 86 Shore C;
(f) a composition comprising a blend of Surlyn® 7940/Surlyn® 8940, optionally including a melt flow modifier;
(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9150), optionally including one or more melt flow modifiers such as an ionomer, ethylene-acid copolymer or ester terpolymer; and
(h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140, 40-50 wt % Surlyn® 9120, and 0-10 wt % Surlyn® 6320).

Surlyn 8150®, Surlyn® 8940, and Surlyn® 8140 are different grades of E/MAA copolymer in which the acid groups have been partially neutralized with sodium ions. Surlyn® 9650, Surlyn® 9910, Surlyn® 9150, and Surlyn® 9120 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Surlyn® ionomers, Fusabond® polymers, and Nucrel® copolymers are commercially available from E. I. du Pont de Nemours and Company.

Suitable E/X- and E/X/Y-type ionomeric materials are further disclosed, for example, in U.S. Pat. Nos. 6,653,382, 6,756,436, 6,894,098, 6,919,393, and 6,953,820, the entire disclosures of which are hereby incorporated by reference.

Suitable polyurethanes, polyureas, and blends and hybrids of polyurethane/polyurea are further disclosed, for example, in U.S. Pat. Nos. 5,334,673, 5,484,870, 6,506,851, 6,756,436, 6,835,794, 6,867,279, 6,960,630, and 7,105,623; U.S. Patent Application Publication No. 2009/0011868; and U.S. Patent Application No. 60/401,047, the entire disclosures of which are hereby incorporated herein by reference. Suitable polyurethane-urea materials include polyurethane/polyurea blends and copolymers comprising urethane and urea segments, as disclosed in U.S. Patent Application Publication No. 2007/0117923, the entire disclosure of which is hereby incorporated herein by reference.

Cover compositions may include one or more filler(s), such as titanium dioxide, barium sulfate, etc., and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Golf balls of the present invention optionally include one or more intermediate layers in addition to the intermediate layer consisting of a minimal surface and an interstitial space. Such layers may be formed from any suitable golf ball composition, including those disclosed herein as suitable core and cover compositions.

Particular Golf Ball Constructions

The present invention is directed to a golf ball comprising a core, an intermediate layer, and a dimpled outer cover layer. The intermediate layer is defined by an envelope shape and consists of a minimal surface and an interstitial space, the minimal surface and the interstitial space being bounded by the envelope shape. The envelope shape has an outer boundary defined by the outer surface of a first three-dimensional shape and an inner boundary defined by the outer surface of a second three-dimensional shape.

In a particular embodiment, the interstitial space is filled with a composition that extends beyond the outer boundary of the envelope shape of the intermediate layer such that the intermediate layer is surrounded by a layer formed from the composition. In a particular aspect of this embodiment, the layer formed from the composition of the interstitial space extending beyond the outer boundary of the envelope shape of the intermediate layer is the outer cover layer, and the composition filling the interstitial space and forming the outer cover layer is optionally selected from the group consisting of polyurethanes, polyureas, and polyurethane-urea hybrids and blends. In another particular aspect of this embodiment, the layer formed from the composition of the interstitial space extending beyond the outer boundary of the envelope shape of the intermediate layer is an additional intermediate layer. In another particular aspect of this embodiment, the core has a solid outer surface and the composition of the interstitial space is bounded by the inner boundary of the envelope shape of the intermediate layer.

In another particular embodiment, the interstitial space is filled with a composition that is bounded by the outer boundary of the envelope shape of the intermediate layer. In a particular aspect of this embodiment, the core has a solid outer surface and the composition of the interstitial space is bounded by the inner boundary of the envelope shape of the intermediate layer. In another particular aspect of this embodiment, the composition of the interstitial space extends beyond the inner boundary of the envelope shape of the intermediate layer. In a further particular aspect, the composition of the interstitial space is liquid, and the core is a liquid core formed from the liquid composition of the interstitial space extending beyond the inner boundary of the envelope shape of the intermediate layer. In another further particular aspect, the composition of the interstitial space is a foamed composition, and the core is a foamed core formed from the foamed composition of the interstitial space extending beyond the inner boundary of the envelope shape of the intermediate layer. In another further particular aspect, the composition of the interstitial space is a thermoplastic composition, and the core is formed from the thermoplastic composition of the interstitial space extending beyond the inner boundary of the envelope shape of the intermediate layer.

In another particular embodiment, the interstitial space is filled with a composition that extends beyond the outer boundary of the envelope shape of the intermediate layer such that the intermediate layer is surrounded by a layer formed from the composition, and the composition of the interstitial space extends beyond the inner boundary of the envelope shape of the intermediate layer. In a particular aspect of this embodiment, the layer formed from the composition of the interstitial space extending beyond the outer boundary of the envelope shape of the intermediate layer is the outer cover layer. In another particular aspect of this embodiment, the layer formed from the composition of the interstitial space extending beyond the outer boundary of the envelope shape of the intermediate layer is an additional intermediate layer. In another particular aspect of this embodiment, the composition of the interstitial space is a foamed composition, and the core is formed from the foamed composition of the interstitial space extending beyond the inner boundary of the envelope shape of the intermediate layer. In another further particular aspect, the composition of the interstitial space is a thermoplastic composition, such as an ionomer composition, and particularly a highly neutralized polymer composition, and the core is formed from the thermoplastic composition of the interstitial space extending beyond the inner boundary of the envelope shape of the intermediate layer.

In another particular embodiment, the interstitial space is hollow. In a particular aspect of this embodiment, the core is a solid, single- or multi-layer core. In another particular aspect of this embodiment, the core is hollow.

EXAMPLES

It should be understood that the examples below are merely illustrative of particular embodiments of the present invention, and are not to be construed as limiting the invention, the scope of which is defined by the appended claims.

In the examples below, the minimal surface corresponds to the triply periodic minimal surface of FIGS. 5A-5C.

Example 1

Figure 6:
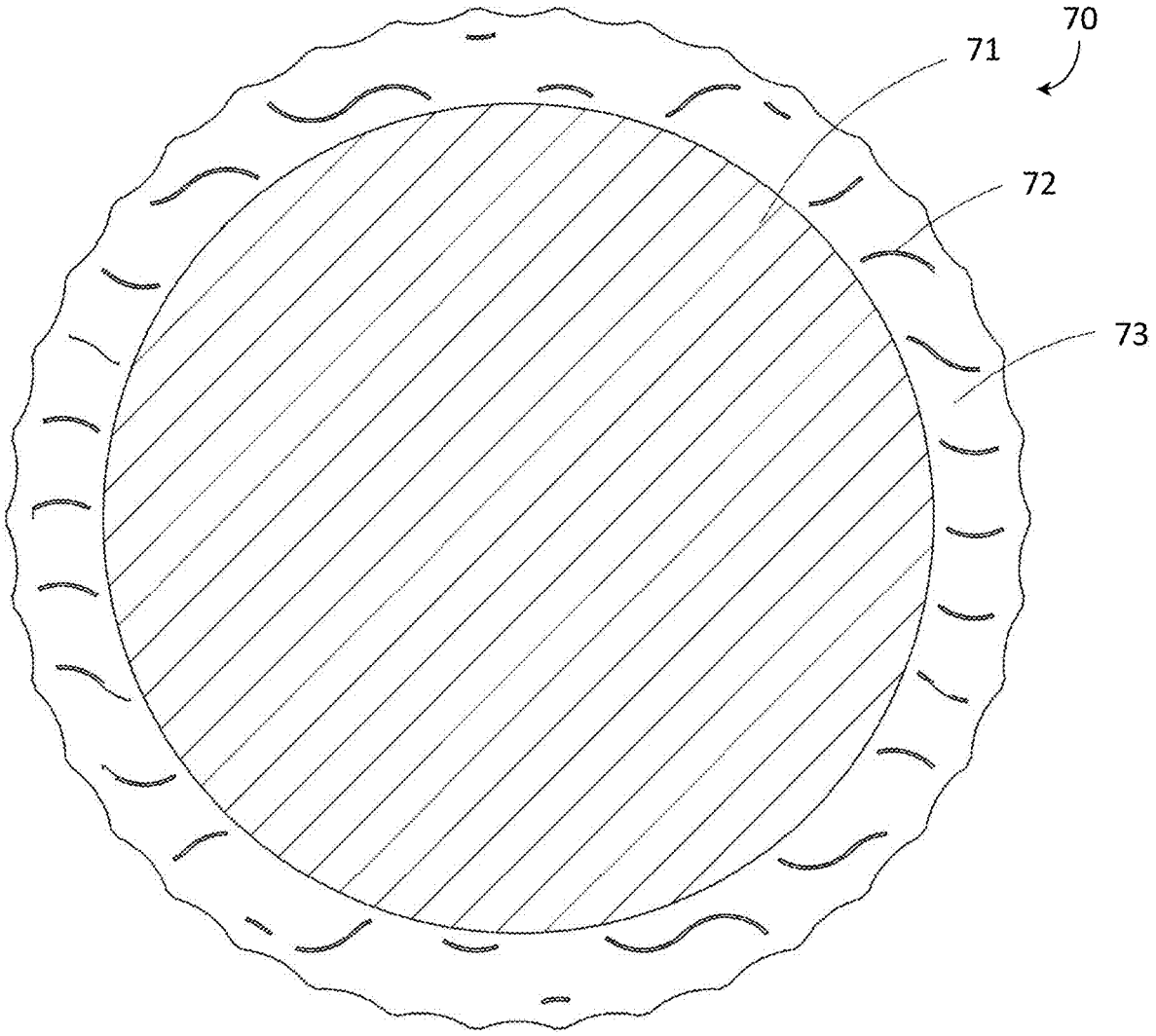
FIG. 6 is a section view of a golf ball according to an embodiment of the present invention.

FIG. 6 illustrates an example of a golf ball construction according to an embodiment of the present invention. In particular, FIG. 6 shows a section view of a golf ball 70, wherein the golf ball comprises a core 71 and an intermediate layer defined by an envelope shape having a spherical outer boundary and a spherical inner boundary and consisting of a minimal surface 72 and an interstitial space 73. The interstitial space is filled with a composition that extends beyond the spherical outer boundary of the envelope shape such that the composition of the interstitial space forms a layer surrounding the intermediate layer and serves as the dimpled outer surface of the golf ball. The composition of the interstitial space can either be bounded by the inner boundary of the envelope shape of the intermediate layer or extend beyond the inner boundary of the envelope shape of the intermediate layer forming a layer that is surrounded by the intermediate layer. While shown in FIG. 6 as a single layer, the core 71 may be a single-, dual-, or multi-layer core.

Example 2

Figure 7:
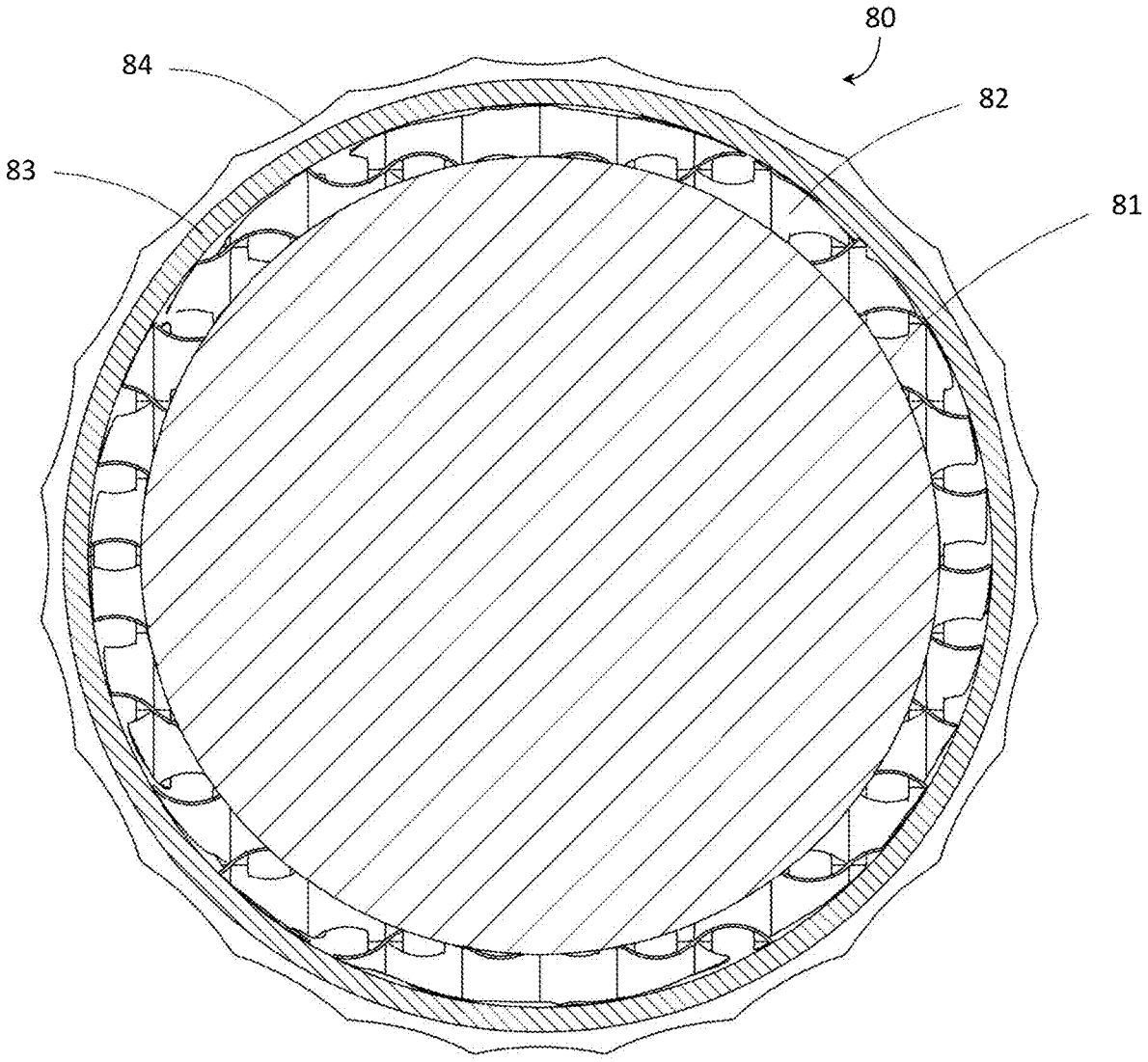
FIG. 7 is a section view of a golf ball according to another embodiment of the present invention.

FIG. 7 illustrates an example of a golf ball construction according to another embodiment of the present invention. In particular, FIG. 7 shows a section view of a golf ball 80, wherein the golf ball comprises a core having an outer surface 81, a first intermediate layer defined by an envelope shape having a spherical outer boundary and a spherical inner boundary and consisting of a minimal surface 82 and a hollow interstitial space, an optional second intermediate layer 83, and an outer cover layer 84. While shown in FIG. 7 as a single layer, the core 81 may be a single-, dual-, or multi-layer core.

Example 3

Figure 8:
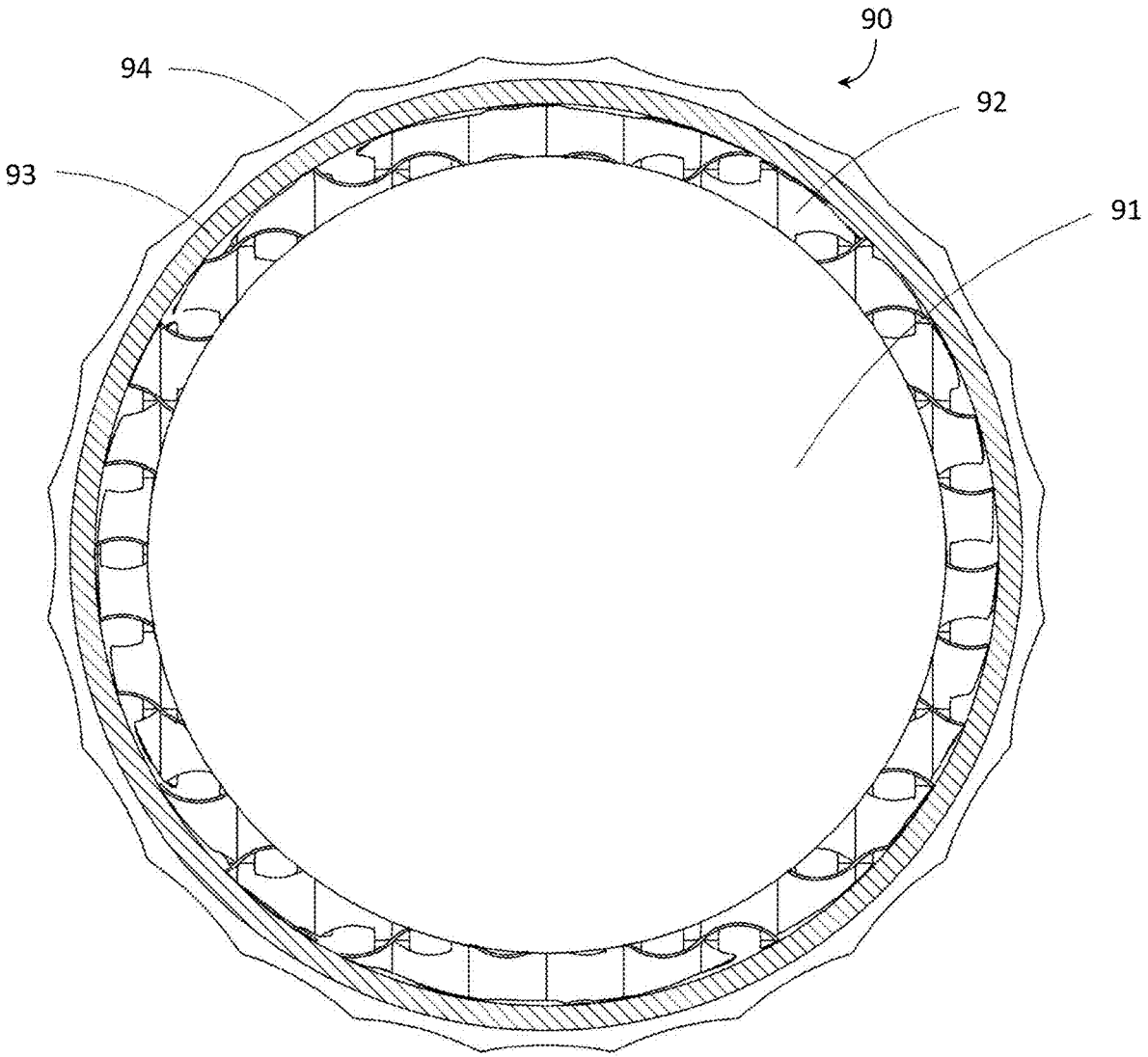
FIG. 8 is a section view of a golf ball according to another embodiment of the present invention.

FIG. 8 illustrates an example of a golf ball construction according to another embodiment of the present invention. In particular, FIG. 8 shows a section view of a golf ball 90, wherein the golf ball comprises a hollow core 91, a first intermediate layer defined by an envelope shape having a spherical outer boundary and a spherical inner boundary and consisting of a minimal surface 92 and a hollow interstitial space, an optional second intermediate layer 93, and an outer cover layer 94.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising a core, an intermediate layer, and a dimpled outer cover layer, wherein:

the intermediate layer has an outer boundary and an inner boundary and consists of a triply periodic minimal surface and an interstitial space, the minimal surface and the interstitial space extending from the inner boundary to the outer boundary, and the minimal surface is a single continuous surface which does not intersect itself and has zero mean curvature.

2. The golf ball of claim 1, wherein the interstitial space is filled with a composition that extends beyond the outer boundary of the intermediate layer such that the intermediate layer is surrounded by a layer formed from the composition.

3. The golf ball of claim 2, wherein the layer formed from the composition of the interstitial space is the dimpled outer cover layer.

4. The golf ball of claim 3, wherein the composition filling the interstitial space and forming the dimpled outer cover layer is a polyurethane composition.

5. The golf ball of claim 3, wherein the composition filling the interstitial space and forming the dimpled outer cover layer is an ionomer composition.

6. The golf ball of claim 2, wherein the layer formed from the composition of the interstitial space is an additional intermediate layer.

7. The golf ball of claim 1, wherein the interstitial space is filled with a composition, and wherein the composition of the interstitial space is bounded by the outer boundary of the intermediate layer.

8. The golf ball of claim 7, wherein the composition is a foamed solid composition.

9. The golf ball of claim 7, wherein the composition is an unfoamed solid composition.

10. The golf ball of claim 7, wherein the composition is a liquid.

11. The golf ball of claim 10, wherein the core is a liquid core formed from the liquid composition of the interstitial space extending beyond the inner boundary of the intermediate layer.

12. The golf ball of claim 1, wherein the interstitial space is hollow.

13. The golf ball of claim 1, wherein the minimal surface has a constant thickness.

14. The golf ball of claim 1, wherein the outer boundary of the intermediate layer has a shape defined by the outer surface of a first three-dimensional shape selected from the group consisting of spheres, cubes, octahedrons, cuboctahedrons, dodecahedrons, tetrahedrons, and icosahedrons, and the inner boundary of the intermediate layer is has a shape defined by the outer surface of a second three-dimensional shape selected from the group consisting of spheres, cubes, octahedrons, cuboctahedrons, dodecahedrons, tetrahedrons, and icosahedrons.

15. The golf ball of claim 14, wherein the first three-dimensional shape is the same shape as the second three-dimensional shape.

16. The golf ball of claim 14, wherein the first three-dimensional shape is a different shape than the second three-dimensional shape.

17. The golf ball of claim 1, wherein the outer boundary of the intermediate layer has a shape defined by the outer surface of a first sphere, and the inner boundary of the intermediate layer has a shape defined by the outer surface of a second sphere.

18. The golf ball of claim 17, wherein the first sphere has a diameter of from 0.50 inches to 1.67 inches, and the second sphere has a diameter of from 0.25 inches to 1.63 inches.

19. The golf ball of claim 1, wherein the outer boundary of the intermediate layer has a shape defined by the outer surface of a first cube, and the inner boundary of the intermediate layer has a shape defined by the outer surface of a second cube.

20. The golf ball of claim 1, wherein the outer boundary of the intermediate layer has a shape defined by the outer surface of a sphere, and the inner boundary of the intermediate layer has a shape defined by the outer surface of a cube.

21. The golf ball of claim 1, wherein the ratio of the volume of the minimal surface ($V_M$) to the volume of the intermediate layer ($V_E$) is less than 1.

22. The golf ball of claim 1, wherein the ratio of the volume of the minimal surface ($V_M$) to the volume of the intermediate layer ($V_E$) is less than 0.50.

23. The golf ball of claim 1, wherein the ratio of the volume of the minimal surface ($V_M$) to the volume of the intermediate layer ($V_E$) is less than 0.25.

24. The golf ball of claim 1, wherein the ratio of the surface area of the minimal surface ($A_M$) to the average surface area of the intermediate layer ($A_E$), where $A_E$ is calculated as the average of the surface area of the outer boundary of the intermediate layer and the inner boundary of the intermediate layer, is less than 1.

25. The golf ball of claim 1, wherein the ratio of the surface area of the minimal surface ($A_M$) to the average surface area of the intermediate layer ($A_E$), where $A_E$ is calculated as the average of the surface area of the outer boundary of the intermediate layer and the inner boundary of the intermediate layer, is greater than 2.

26. The golf ball of claim 1, wherein the ratio of the surface area of the minimal surface ($A_M$) to the average surface area of the intermediate layer ($A_E$), where $A_E$ is calculated as the average of the surface area of the outer boundary of the intermediate layer and the inner boundary of the intermediate layer, is greater than 4.

27. The golf ball of claim 1, wherein the core is hollow.

* * * * *